US008744316B2

(12) United States Patent
Morino et al.

(10) Patent No.: US 8,744,316 B2
(45) Date of Patent: Jun. 3, 2014

(54) CHARGED PARTICLE GENERATOR, CHARGING DEVICE, AND IMAGE FORMING APPARATUS

(75) Inventors: Takanori Morino, Kanagawa (JP); Masao Ohmori, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 304 days.

(21) Appl. No.: 13/024,864

(22) Filed: Feb. 10, 2011

(65) Prior Publication Data

US 2012/0051789 A1 Mar. 1, 2012

(30) Foreign Application Priority Data

Sep. 1, 2010 (JP) ..... 2010-195320

(51) Int. Cl.
*G03G 15/02* (2006.01)

(52) U.S. Cl.
USPC ..... 399/171; 399/173; 361/229; 361/230; 430/902; 250/324; 250/325; 250/326

(58) Field of Classification Search
USPC ..... 399/171, 173
See application file for complete search history.

(56) References Cited

U.S. PATENT DOCUMENTS

| | | | | |
|---|---|---|---|---|
| 4,697,196 | A * | 9/1987 | Inaba et al. | 347/127 |
| 5,245,502 | A * | 9/1993 | Genovese | 361/225 |
| 6,359,383 | B1 * | 3/2002 | Chuang et al. | 313/496 |
| 7,138,760 | B2 * | 11/2006 | Kim | 313/497 |
| 8,577,262 | B2 * | 11/2013 | Ohmori et al. | 399/168 |
| 8,588,652 | B2 * | 11/2013 | Ohmori et al. | 399/168 |
| 2004/0174110 | A1 * | 9/2004 | Ito | 313/310 |
| 2006/0255344 | A1 * | 11/2006 | Choi et al. | 257/82 |
| 2007/0252510 | A1 * | 11/2007 | Ha | 313/495 |
| 2009/0303654 | A1 * | 12/2009 | Fan et al. | 361/229 |
| 2009/0324289 | A1 * | 12/2009 | Fan et al. | 399/168 |
| 2010/0158548 | A1 * | 6/2010 | Wong et al. | 399/29 |
| 2011/0129257 | A1 * | 6/2011 | Ohmori et al. | 399/168 |
| 2012/0051790 | A1 * | 3/2012 | Ohmori et al. | 399/168 |

FOREIGN PATENT DOCUMENTS

| | | |
|---|---|---|
| JP | A-11-15232 | 1/1999 |
| JP | 2000-156147 A | 6/2000 |
| JP | 2002-279885 A | 9/2002 |

OTHER PUBLICATIONS

English Translation of Japanese Office Action for Application No. 2010-195320 mailed Jan. 21, 2014.

* cited by examiner

*Primary Examiner* — David Gray
*Assistant Examiner* — Geoffrey Evans
(74) *Attorney, Agent, or Firm* — Oliff PLC

(57) ABSTRACT

A charged particle generator includes a first electrode, a second electrode, and an insulating material that is provided between the first electrode and the second electrode. Charged particles are generated by discharge that occurs between the first and the second electrodes. The first electrode, the insulating material, and the second electrode are arranged in a first direction. The second electrode has a shape that does not intersect a path along which the charged particles move in a second direction perpendicular to the first direction.

11 Claims, 6 Drawing Sheets

CHARGED PARTICLE GENERATOR, CHARGING DEVICE, AND IMAGE FORMING APPARATUS

CROSS-REFERENCE TO RELATED APPLICATIONS

This application is based on and claims priority under 35 USC 119 from Japanese Patent Application No. 2010-195320 filed Sep. 1, 2010.

BACKGROUND (i) Technical Field

The present invention relates to a charged particle generator, a charging device, and an image forming apparatus.

(ii) Related Art

As a scheme for charging an image carrier of an image forming apparatus, a scorotron charging scheme utilizing corona discharge is used in some cases. In the scorotron charging scheme, a member to be charged is charged in a non-contact manner. As another charging scheme, a charging-roller scheme in which a charging process is performed by causing discharge to occur in a very small spacing that is generated between a semiconducting charging roller and an image carrier when the charging roller rotates in contact with the image carrier is used in some cases.

SUMMARY

According to a first aspect of the invention, there is provided a charged particle generator including a first electrode, a second electrode, and an insulating material that is provided between the first electrode and the second electrode. Charged particles are generated by discharge that occurs between the first and the second electrodes. The first electrode, the insulating material, and the second electrode are arranged in a first direction. The second electrode has a shape that does not intersect a path along which the charged particles move in a second direction perpendicular to the first direction.

BRIEF DESCRIPTION OF THE DRAWINGS

Exemplary embodiments of the present invention will be described in detail based on the following figures, wherein.

DETAILED DESCRIPTION

First Exemplary Embodiment

Exemplary embodiments of the present invention will be described with reference to the drawings.

Figure 1:
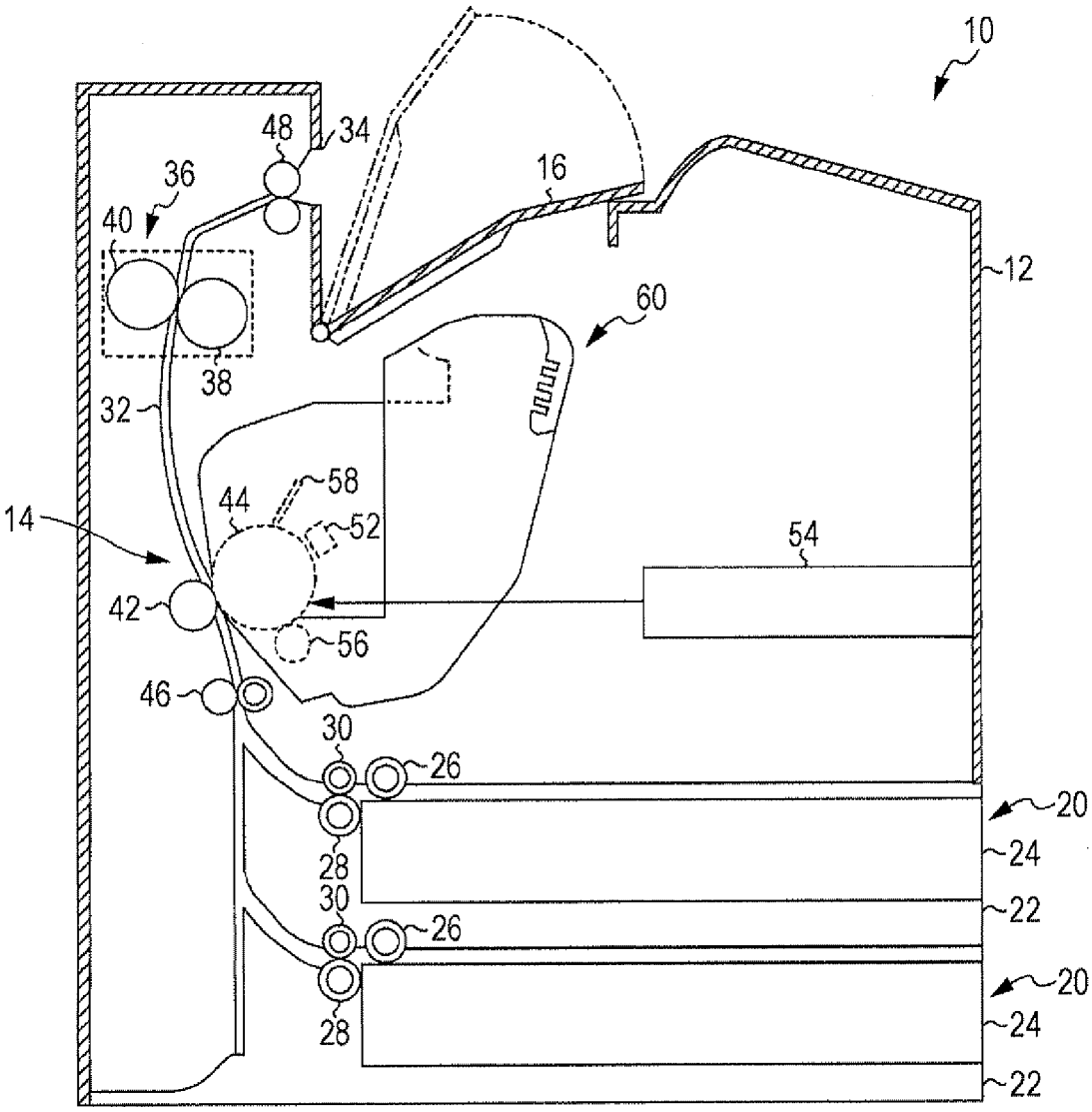
FIG. 1 is a schematic diagram illustrating an image forming apparatus to which a first exemplary embodiment of the present invention is applied.

FIG. 1 illustrates an overall configuration of an image forming apparatus 10 according to a first exemplary embodiment of the present invention.

The image forming apparatus 10 includes an image-forming-apparatus body 12. An image forming unit 14 is mounted inside the image-forming-apparatus body 12. An ejection unit 16 is provided on the top portion of the image-forming-apparatus body 12.

Under the bottom portion of the image-forming-apparatus body 12, for example, sheet feeding devices 20 that are provided at two stages are disposed. Below the image-forming-apparatus body 12, further multiple sheet feeding devices may be added and disposed.

Each of the sheet feeding devices 20 includes a sheet-feeding-device body 22 and a sheet feeding cassette 24 in which recording media are stored. A pickup roller 26 is provided above and close to the rear end of the sheet feeding cassette 24. A retard roller 28 is disposed behind the pickup roller 26. A feed roller 30 is disposed at a position at which the feed roller 30 faces the retard roller 28.

A transport path 32 is a path that extends from the feed roller 30 to an ejection hole 34 and that is used for a recording medium. The transport path 32 is provided close to the rear side (a face on the left side in FIG. 1) of the image-forming-apparatus body 12, and has a portion that is substantially vertically formed from the sheet feeding device 20, which is provided at the bottom end, to a fixing unit 36.

A heating roller 38 and a pressure roller 40 are provided in the fixing unit 36. A transfer roller 42 and an image carrier 44 that serves as a photoconductor are disposed on the upstream side of the fixing unit 36 along the transport path 32. A register roller 46 is disposed on the upstream side of the transfer roller 42 and the image carrier 44. An ejection roller 48 is disposed close to the ejection hole 34 along the transport path 32.

Accordingly, a recording medium that has been sent from the sheet feeding cassette 24 of the sheet feeding device 20 by the pickup roller 26 is handled by cooperation of the retard roller 28 and the feed roller 30. In this manner, a recording medium that is provided as a top sheet in the sheet feeding cassette 24 is transported to the transport path 32, and is stopped for a brief period of time by the register roller 46 so that timing is adjusted for the recording medium. The recording medium passes between the transfer roller 42 and the image carrier 44, and a developer image is transferred onto the recording medium. The transferred developer image is fixed onto the recording medium by the fixing unit 36, and is ejected from the ejection hole 34 to the ejection unit 16 by the ejection roller 48.

The image forming unit 14 operates, for example, as an electrophotographic system. The image forming unit 14 includes the following: the image carrier 44; a charging device 52 that uniformly charges the image carrier 44; an optical writing device 54 that writes a latent image onto the image carrier 44, which has been charged by the charging device 52, using light; a developing device 56 that visualizes the latent image, which has been formed on the image carrier 44 by the optical writing device 54, using a developer, thereby obtaining a developer image; the transfer roller 42 that transfers the developer image, which has been obtained by the developing device 56, onto a recording medium; a cleaning device 58 that cleans the residual developer remaining on the image carrier 44 and that includes a blade; and the fixing unit 36 that fixes the developer image, which has been transferred onto the recording medium by the transfer roller 42, on the recording medium.

A process cartridge 60 is obtained by integrating, into one piece, the image carrier 44, the charging device 52, the developing device 56, and the cleaning device 58. With the process cartridge 60, the image carrier 44, the charging device 52, the developing device 56, and the cleaning device 58 can be exchanged as one piece. The ejection unit 16 is opened, and then, the process cartridge 60 can be taken out from the image-forming-apparatus body 12.

Next, the details of the charging device 52 will be described.

Figure 2:
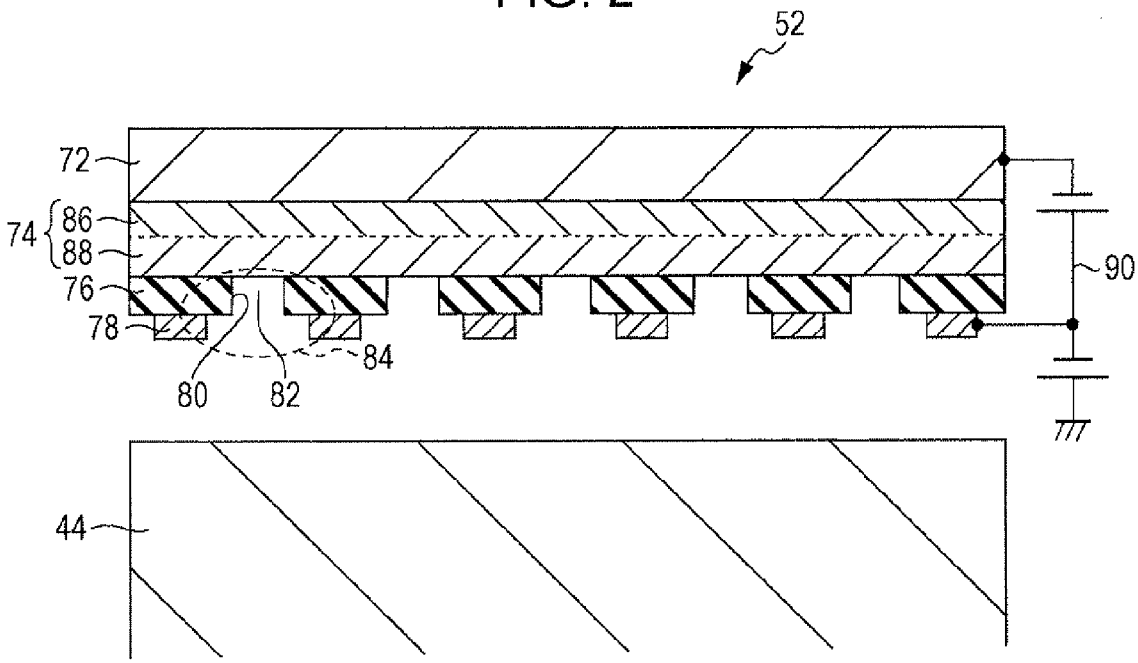
FIG. 2 is a diagram illustrating a cross sectional view of a charging device to which the first exemplary embodiment of the present invention is applied and illustrating a structure of portions surrounding the charging device.
Figure 3:
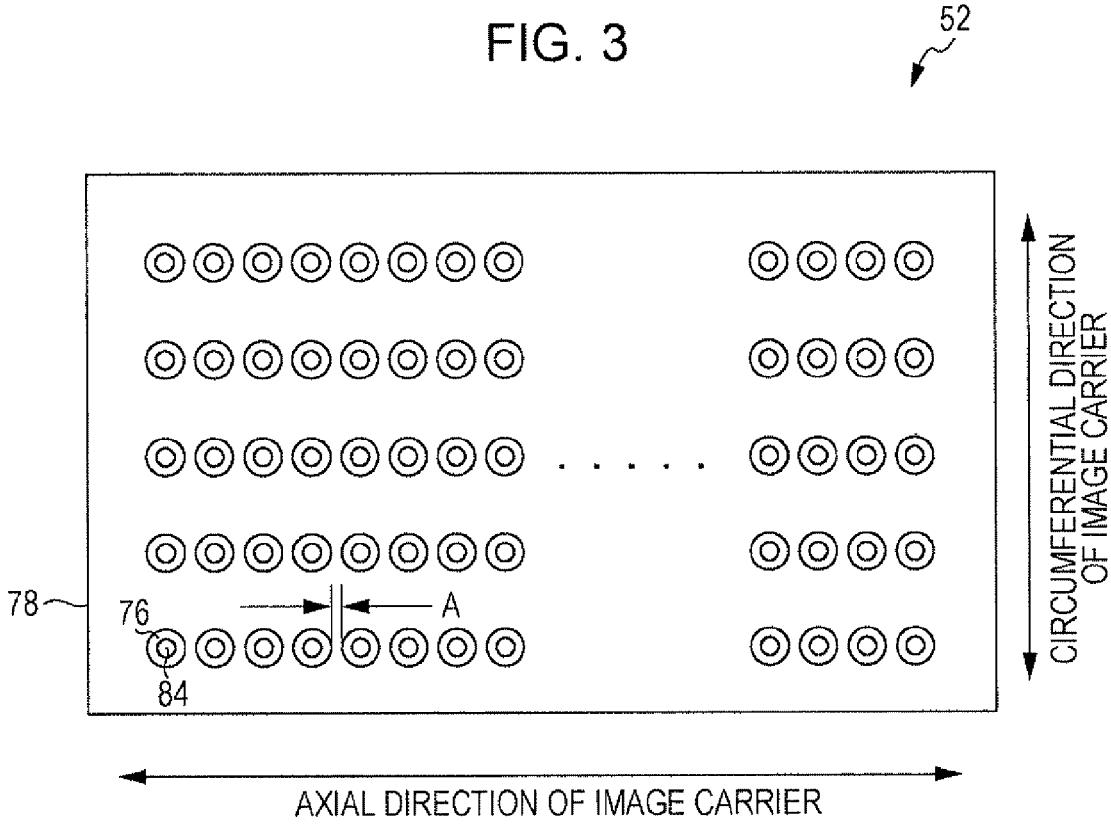
FIG. 3 is a diagram illustrating the bottom face of the charging device to which the first exemplary embodiment of the present invention is applied.

FIG. 2 illustrates a cross sectional view of the charging device 52, and a structure of portions surrounding the charging device 52. FIG. 3 illustrates the bottom face (a face on the image carrier 44 side) of the charging device 52.

The charging device 52 has a configuration in which a conductive base material 72, a resistive layer 74, an insulating layer 76, and a conductive layer 78 are arranged in this order from the layer farthest from the image carrier 44 that faces the charging device 52.

A first electrode is formed of the conductive base material 72 and the resistive layer 74. A second electrode is formed of the conductive layer 78.

The conductive layer 78 is disposed at least in a projection range of the insulating layer 76. The conductive layer 78 is formed on the insulating layer 76 so that the conductive layer 78 does not extend off the insulating layer 76 (so that the conductive layer 78 is not in contact with region limiters 82 on a face of the conductive layer 78 on the resistive layer 74 side).

Openings 80 are provided in the conductive layer 78. The region limiters 82 are provided in the insulating layer 76, and each of the region limiters 82 and a corresponding one of the openings 80 form a continuous space. The region limiter 82 is formed to be open in a direction in which the region limiter 82 faces the image carrier 44, e.g., is formed in a cylindrical shape. As described above, the region limiter 82 is open in a direction in which the region limiter 82 and the opening 80 form a continuous space, and is a space that is limited in a direction perpendicular to the above-mentioned direction.

A discharge region 84 includes the opening 80 and the region limiter 82.

A hole radius of the opening 80 is larger than that of the region limiter 82. The term "hole radius" refers to a length (radius) in a direction (hereinafter, referred to as a "horizontal direction" in some cases) that is perpendicular to a direction (hereinafter, referred to as a "stacking direction" in some cases) in which the conductive base material 72, the resistive layer 74, the insulating layer 76, and the conductive layer 78 are arranged.

As described above, in the present exemplary embodiment, the area of the opening 80 is larger than that of the region limiter 82.

The resistive layer 74 is formed to have a two-layer structure constituted by a high resistive layer 86 and a resistance adjustment layer 88. Not that the resistive layer 74 may have a one-layer structure constituted by one material.

A voltage applying unit 90 that applies a voltage to each of the conductive base material 72 and the conductive layer 78 is connected thereto.

When voltages equal to or higher than fixed voltages are applied to the conductive base material 72 and the conductive layer 78, discharge occurs in the discharge region 84 that is spatially limited by being surrounded by the resistive layer 74, the insulating layer 76, and the conductive layer 78.

Since the discharge region 84 is spatially limited in a direction (the horizontal direction) that is parallel to an axial direction of the image carrier 44, the discharge region 84 two-dimensionally limits discharge.

The discharge region 84 is open in a direction in which the discharge region 84 faces the image carrier 44. Accordingly, due to the potential difference between the conductive layer 78 and the image carrier 44, some charged particles (ions) that have been generated by discharge pass through the opening 80 of the conductive layer 78, and move to the image carrier 44 side. In other words, a configuration is provided, in which ions that have been generated in the discharge region 84 drift due to an electric field or diffuse from the resistive layer 74 to the image carrier 44, thereby charging the image carrier 44. Here, the term "drifting" refers to movement of ions due to an electric field.

The conductive layer 78 adjusts, using an applied voltage, the intensity of the electric field for causing ions to move to the image carrier 44, and simultaneously has a function of adjusting the charge potential of the image carrier 44.

Next, the details of the discharge region 84 and a structure of portions surrounding the discharge region 84 will be described.

Figure 4:
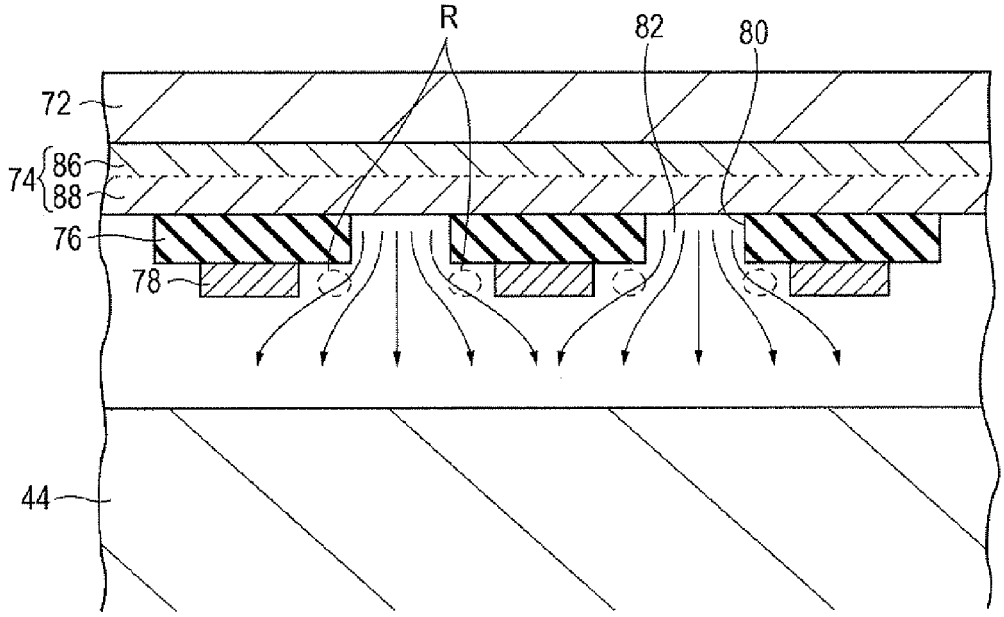
FIG. 4 is a schematic diagram illustrating flows of charged particles in a discharge region.
Figure 5:
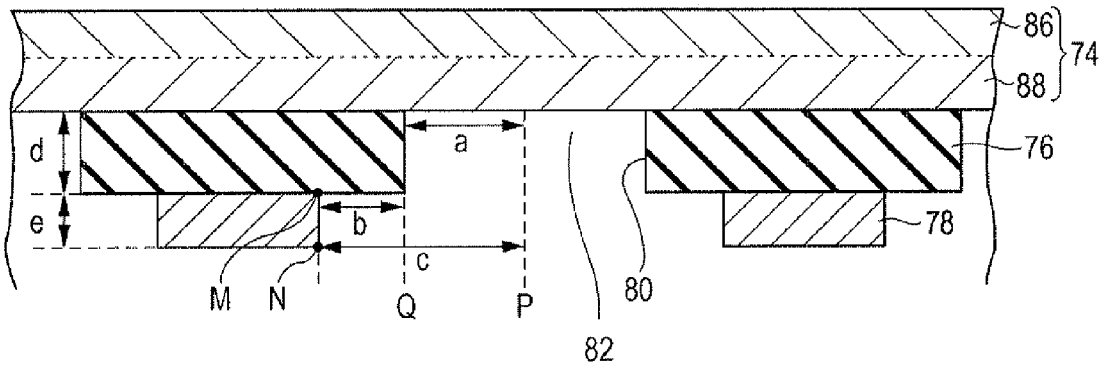
FIG. 5 is an exemplary diagram for explaining a configuration of portions surrounding the discharge region.

FIG. 4 is a schematic diagram illustrating flows of charged particles in the discharge region 84. FIG. 5 is an exemplary diagram for explaining a configuration of the portions surrounding the discharge region 84.

As illustrated in FIG. 4, ions that have been generated by discharge move toward the image carrier 44 while spreading out in the horizontal direction. Here, regarding the ions generated by discharge, when the conductive layer 78 exists at certain points along paths along which the ions move from the resistive layer 74 to the image carrier 44, the ions are absorbed by the conductive layer 78. In other words, the ions are consumed without causing the image carrier 44 to be charged.

When the conductive layer 78 exists in a range R, ions that have spread out and moved from the region limiter 82 in the horizontal direction are absorbed by the conductive layer 78 that exists in the range R. Here, the range R is along the paths along which the ions moving from the region limiter 82 toward the image carrier 44 pass, and is a range (the projection range of the insulating layer 76) that is defined inside the insulating layer 76 in the horizontal direction.

Accordingly, the conductive layer 78 has a shape that does not intersect the paths along which charged particles generated by discharge in the discharge region 84 move in the horizontal direction, thereby reducing absorption of the charged particles by the conductive layer 78. Here, regarding the shape of the conductive layer 78, the term "shape" refers a formation including, for example, a form, a size (a length in the horizontal direction), and a thickness (a length in the stacking direction).

For example, the length of the conductive layer 78 in the horizontal direction is reduced, i.e., the hole radius of the opening 80 is increased to be larger than that of the region limiter 82, whereby the conductive layer 78 and the range R are prevented from overlapping each other or whereby a range in which the conductive layer 78 and the range R overlap each other is reduced.

As illustrated in FIG. 5, a length a is a distance (a hole radius of the region limiter 82) from a center P of the region limiter 82 in the horizontal direction to a side face of the insulating layer 76 (which is a face serving as the boundary between the insulating layer 76 and the region limiter 82).

A length b is a distance from a line Q, which is the same as a line along the stacking direction on the side face of the insulating layer 76, to a side face of the conductive layer 78 (which is a face serving as the boundary between the conductive layer 78 and the opening 80). The length b may be fixed. Alternatively, the length b may be changed in accordance with the distance to the image carrier 44, for example, so that the length b increases with decreasing distance to the image carrier 44.

A length c is a distance from the center P to the side face of the conductive layer 78 that is closest to the image carrier 44. When the length b is fixed with respect to the distance to the image carrier 44, the length c is the same as a length obtained by adding the length a to the length b (an equation the length c=the length a+the length b is established).

A length d is a length (a thickness) of the insulating layer 76 in the stacking direction.

A length e is a length (a thickness) of the conductive layer 78 in the stacking direction.

A position M is a position on the conductive layer 78, is located at the boundary between the conductive layer 78 and the opening 80, and is closest to the insulating layer 76.

A position N is a position on the conductive layer 78, is located at the boundary between the conductive layer 78 and the opening 80, and is closest to the image carrier 44.

A line connecting the positions M and N may be a straight line or a curve. In other words, the side face of the conductive layer 78 may be a plane or a curved surface.

The lengths a to e have, for example, the following relationships:

$$2\ \mu m \le a < c \le 200\ \mu m;$$

$$0 < b \le c - a \le 198\ \mu m;$$

$$4\ \mu m \le d \le 500\ \mu m;$$

and $$0 < e \le 50\ \mu m.$$

The region limiter 82 is formed so that the length a (the hole radius of the region limiter 82) is in a range of 2 μm to smaller than 200 μm.

The opening 80 is formed so that the length b is in a range of larger than 0 μm to 198 μm.

The opening 80 is formed so that the length c is in a range of larger than 2 μm to 200 μm (however, the lengths a and c have a relationship a<c).

When the hole radius of the region limiter 82 is smaller than 2 μm, the amount of charged particles generated by discharge per region limiter 82 decreases. As a result, an efficiency with which the charging device 52 operates as a charger decreases. Accordingly, in order to more efficiently charge the image carrier 44 so that the image carrier 44 has a target potential, the hole radius of the discharge region 84 may be equal to or larger than 2 μm.

When the hole radius of the opening 80, which is larger than the hole radius of the region limiter 82, is larger than 200 μm, a calculation result that the intensity of each of electric fields which are generated at the edge (rim) of the opening 80 or at portions surrounding the opening 80 is several times or more higher than that of an electric field which is generated at the center of a space in the discharge region 84 is obtained using typical analytical calculation for an electrostatic field. When the electric field distribution in the discharge region 84 becomes uniform and discharge is concentrated at the portions surrounding the opening 80, as a result, discharge becomes unstable, so that the amount of generated ozone may increase or the resistive layer 74 may be shorted.

When the hole radius of the opening 80, which is larger than the hole radius of the region limiter 82, is equal to or smaller than 200 μm, equipotential surfaces are formed to an extent that the equipotential surfaces are approximately parallel to an insulating material. Accordingly, the electric field distribution in the region limiter 82 becomes uniform, so that stable discharge readily occurs over the discharge region 84.

When the hole radius of the region limiter 82 is in a range of 30 μm to 80 μm, compared with a case in which the hole radius of the region limiter 82 is not in the range of 30 μm to 80 μm, uniform discharge occurs over the entire discharge region 84 with a high efficiency.

When the hole radius of the opening 80 is in a range of 40 μm to 100 μm, compared with a case in which the hole radius of the opening 80 is not in the range of 40 μm to 100 μm, absorption of ions, which have been generated in the discharge region 84, by the insulating layer 76 is more reduced.

The insulating layer 76 is formed so that the length d (the thickness of the insulating layer 76) is in a range of 4 μm to 500 μm.

In the present exemplary embodiment, the region limiter 82 included in the discharge region 84 is provided in the insulating layer 76. Accordingly, the length d (the thickness of the insulating layer 76) limits the distance between both of the electrodes (the resistive layer 74 and the conductive layer 78), i.e., a discharge distance.

The length d (the thickness of the insulating layer 76) is a length of the region limiter 82 in the staking direction.

When the thickness of the insulating layer 76 is set to be 500 μm or larger, a discharge start voltage increases.

When the discharge distance is reduced by setting the thickness of the insulating layer 76 to be 500 μm or smaller, regional concentration of discharge and sharp increase in a discharge current are reduced, so that continuous discharge readily occurs.

When the discharge distance is made much larger an the mean free path (about 0.1 μm) of electrons in the air by setting the thickness of the insulating layer 76 to be 4 μm or larger, the number of frequencies of ionization in the region limiter 82 is ensured, so that continuous discharge readily occurs.

According to Paschen's law defining a discharge start voltage applied between parallel flat plates in the air or under the atmospheric pressure, when a spacing is about 4 μm, the discharge start voltage has a minimum value. When the spacing is smaller than 4 μm, the discharge start voltage increases. This indicates that, when the thickness of the insulating layer 76 is smaller than 4 μm, discharge does not readily occur.

When the thickness of the insulating layer 76 is in a range of 50 μm to 150 μm, compared with a case in which the thickness of the insulating layer 76 is not in the range of 50 μm to 150 μm, an insulating property that is obtained between the electrodes or uniform discharge is more stably maintained for application of high voltages to the electrodes.

The conductive layer 78 is formed so that the length e (the thickness of the conductive layer 78) is in a range of larger than 0 μm to 50 μm.

When the thickness of the conductive layer 78 is larger than 50 μm, the efficiency with which charged particles are caused to move from the opening 80 to the image carrier 44 does not sufficiently increase.

When the thickness of the conductive layer 78 is in a range of 1 μm or smaller, compared with a case in which the thickness of the conductive layer 78 is in a range of 1 μm or larger, absorption of ions by the conductive layer 78 is more reduced.

As described above, the conductive layer 78 has a shape that does not intersect the paths along which charged particles generated by discharge in the discharge region 84 move in the horizontal direction.

Next, the details of the individual elements will be described.

As a material that the conductive base material 72 is formed of, a metal such as stainless, aluminum, a copper alloy, an alloy of metals among the above-mentioned metals, or an iron that is subjected to surface treatment with chrome, nickel, or the like is used.

As a material that the resistive layer 74 is formed of, a material having a volume resistivity that is in a range of $1\times10^{6}$ Ωcm to $1\times10^{10}$ Ωcm is used.

When the volume resistivity of the resistive layer 74 is higher than $1\times10^{10}$ Ωcm, discharge that occurs between the electrodes tends to be insufficient. Discharge may occur at random in the region limiter 82 which is a discharge region, so that it may be difficult to achieve stable discharge.

When the volume resistivity of the resistive layer 74 is lower than $1\times10^{6}$ Ωcm, an effect (hereinafter, referred to as a "discharge-current control effect" in some cases) of controlling the discharge current using a resistance is not sufficiently obtained, and discharge is regionally concentrated in the surface of the resistive layer 74 that faces the region limiter 82. As a result, the discharge current may become unstable or excessive, and this may lead to rapid degradation of materials or to shorting of the resistive layer 74.

When the volume resistivity of the resistive layer 74 is in a range of $1\times10^{7}$ Ωcm to $1\times10^{9}$ Ωcm, compared with a case in which the volume resistivity of the resistive layer 74 is not in the range of $1\times10^{7}$ Ωcm to $1\times10^{9}$ Ωcm, more stable discharge continues in the region limiter 82.

The resistive layer 74 is formed to have a thickness that is in a range of 10 μm or larger.

From the viewpoint of obtaining the discharge-current control effect using a resistance of the resistive layer 74, the resistance value of the resistive layer 74, which is calculated from a formula "a volume resistivity×the thickness of a resistive layer/a unit area", may be adjusted by reducing the thickness of the resistive layer 74 and by selecting a material having a high resistivity. However, when the thickness of the resistive layer 74 is smaller than 10 μm, a resistance property (a withstand voltage) for an applied voltage is reduced, so that the number of frequencies of shorting of the resistive layer 74 in a case of discharge increases.

When the resistive layer 74 is formed so that the thickness of the resistive layer 74 is in a range of 100 μm or larger, compared with a case in which the thickness of the resistive layer 74 is in a range of smaller than 100 μm, a sufficient withstand voltage is obtained, and a temporal stability for application of high voltages is ensured.

The resistive layer 74 is adjusted so that the resistance value (which is a value calculated from a formula a volume resistivity×the thickness of a resistive layer/an area wherein the area is an area of a circle having a diameter of 100 μm) of the resistive layer 74 in the thickness direction is in a range of $1\times10^{8}$Ω to $1\times10^{11}$Ω while the volume resistivity of the resistive layer 74 satisfies the above-described appropriate range, which is a range of $1\times10^{7}$ Ωcm to $1\times10^{9}$ Ωcm and the thickness of the resistive layer 74 satisfies the above-described appropriate range, which is a range of 100 μm or larger. In this case, both the discharge-current control effect using a resistance component and the temporal stability that is obtained by ensuring a certain thickness are achieved.

In a case in which the discharge-current control effect is adjusted by forming the resistive layer 74 as a layer having a two-layer structure, for example, the discharge-current control effect may be sufficiently obtained by forming an upper layer (the high resistive layer 86) having a volume resistivity of $1\times10^{9}$ Ωcm and a thickness of 30 μm. The resistive layer 74 may be made thick by forming a lower layer (the resistance adjustment layer 88) having a volume resistivity of $1\times10^{7}$ Ωcm and a thickness of 100 μm.

As described above, the discharge-current control effect using a resistance is ensured using the upper layer (the high resistive layer 86), and the resistance property is improved by making the resistive layer 74 thick using the lower layer (the resistance adjustment layer 88) so that the resistive layer 74 has a sufficient thickness which is measured from the conductive base material 72, thereby achieving both the discharge-current control effect and the temporal stability.

As the resistive layer 74, a material that is obtained by dispersing conductive particles or semiconducting particles in a resin material or a rubber material is used.

For example, a polyester resin, an acrylic resin, a melamine resin, an epoxy resin, a urethane resin, a silicone resin, a urea resin, a polyamide resin, a polyimide resin, a polycarbonate resin, a styrene resin, an ethylene resin, a synthetic resin of resin materials among the above-mentioned resin materials is used as the resin material.

Ethylene propylene rubber, polybutadiene, natural rubber, polyisobutylene, chloroprene rubber, silicon rubber, urethane rubber, epichlorohydrin rubber, fluorosilicone rubber, ethylene oxide rubber, a foaming agent that is obtained by foaming a rubber material among the above-mentioned rubber materials, or a mixture of rubber materials among the above-mentioned rubber materials is used as the rubber material.

As the conductive particles or the semiconducting particles, a material such as carbon black, zinc, aluminum, copper, iron, nickel, chromium, or titanium, a metallic oxide such as ZnO—$Al_2lO_3$, $SnO_2$—$Sb_2O_3$, $In_2O_3$—$SnO_2$, ZnO—$TiO_2$, MgO—$Al_2O_3$, FeO—$TiO_2$, $TiO_2$, $SnO_2$, $Sb_2O_3$, $In_2O_3$, ZnO, or MgO, an ionic compound such as a quaternary ammonium salt, or a mixture of one type of or two or more types of materials among the above-mentioned materials is used.

In addition, the resistive layer 74 may be formed of not only an organic material such as a resin or a rubber, but also a semiconducting glass that is obtained by dispersing conductive particles in a glass, an aluminum porous anodic oxide film, or the like.

The structure of the region limiter 82 is determined in accordance with the hole radius thereof and the thickness of the insulating layer 76.

A material that the insulating layer 76 is formed of is not limited to an organic material or an inorganic material. When a material that the insulating layer 76 is formed of is a solid material having a volume resistivity of $1\times10^{12}$ Ωcm or higher, compared with a case in which the volume resistivity is lower than $1\times10^{12}$ Ωcm, an excellent insulating property is obtained between both of the electrodes (the resistive layer 74 and the conductive layer 78) when high voltages are applied to the electrodes, and the shape of the region limiter 82 is stably maintained without being deformed over time.

As a material that the conductive layer 78 is formed of, a material having a volume resistivity of 0.1 Ωcm or lower is used. Furthermore, as a material that the conductive layer 78 is formed of, a metal that is not readily contaminated by discharge gas is used. For example, a metallic material such as tungsten, molybdenum, carbon, platinum, copper, or aluminum, or a material that is obtained by performing surface treatment, such as gold plating, on one of the above-mentioned metallic materials is used.

The charging device 52 charges the image carrier 44 using movement (drifting) of charged particles due to an electric field. Accordingly, the charging device 52 is disposed at a certain position, and, at the certain position, a distance at which discharge does not occur between the conductive layer 78, which is disposed closer to the image carrier 44, and the image carrier 44 is maintained.

More specifically, the charging device 52 is disposed so that a distance (a nearest neighbor distance) at which the conductive layer 78 is closest to the image carrier 44 is equal to or longer than 300 μm and equal to or shorter than 2 mm.

When the nearest neighbor distance between the conductive layer 78 and the image carrier 44 is longer than 2 mm, the charge efficiency decreases.

When the nearest neighbor distance between the conductive layer 78 and the image carrier 44 is shorter than 300 μm, discharge readily occurs between the conductive layer 78 and the image carrier 44, so that a load is applied to the image carrier 44. For example, it is supposed that a voltage of "−2 kV" is applied to the resistive layer 74 and a voltage of "−750 V" is applied to the conductive layer 78 for a voltage of "−700 V" that is a target charge potential of the image carrier 44. In this case, when the nearest neighbor distance is shorter than 300 μm, according to estimation of a discharge start voltage that is obtained using Paschen's law, there is a possibility that charged particles move from the resistive layer 74 and pass through the conductive layer 78, and that discharge of the charged particles to the image carrier 44 occurs.

In order that the image carrier 44 have a uniform potential without having a non-uniform potential in streaks influenced by ions that have moved from the discharge region 84 to the top of the image carrier 44 due to an electric field, a distance A (see FIG. 3) between the discharge regions 84 (the openings 80) adjacent to each other in the axial direction of the image carrier 44 is set to be at least as short as or equal to or shorter than the distance between the conductive layer 78 and the image carrier 44.

The number of lines of the discharge regions 84 in the rotation direction of the image carrier 44 is adjusted so that a necessary charge capability can be ensured in accordance with a process speed.

For example, the discharge regions 84 are formed in a line at intervals of 300 μm so as to be parallel to the rotation-axis direction of the image carrier 44, and so as to have only a width necessary for discharge. In order to improve the charge capability, similar five lines are arranged at intervals of 750 μm in the circumferential direction of the image carrier 44.

Examples of a method for making the configuration in the present exemplary embodiment include a method using mechanical punching, a method using a printing technique such as screen printing, a method using an inkjet printing technique, and a method in which masking is performed and evaporation or etching is performed.

Examples of the method using mechanical punching, include the following method: a metallic material (the conductive layer 78) is evaporated or applied onto the insulating layer 76; holes are formed by drilling, punching, or the like; and the insulating layer 76 is caused to come into contact with and fixed on the resistive layer 74. Note that, after holes are formed, a slope (a taper) may be formed on the conductive layer 78 by reaming or the like.

Examples of the method using a printing technique such as screen printing include the following method: insulating ink for forming the insulating layer 76 and conductive ink for forming the conductive layer 78 are printed using a desired pattern. As the insulating ink, ultraviolet curable resist ink or the like may be used. Furthermore, as the conductive ink, silver or graphite ink, or the like may be used.

Example

Hereinafter, Example will be described. However, the present invention is not limited to Example.

Figure 6:
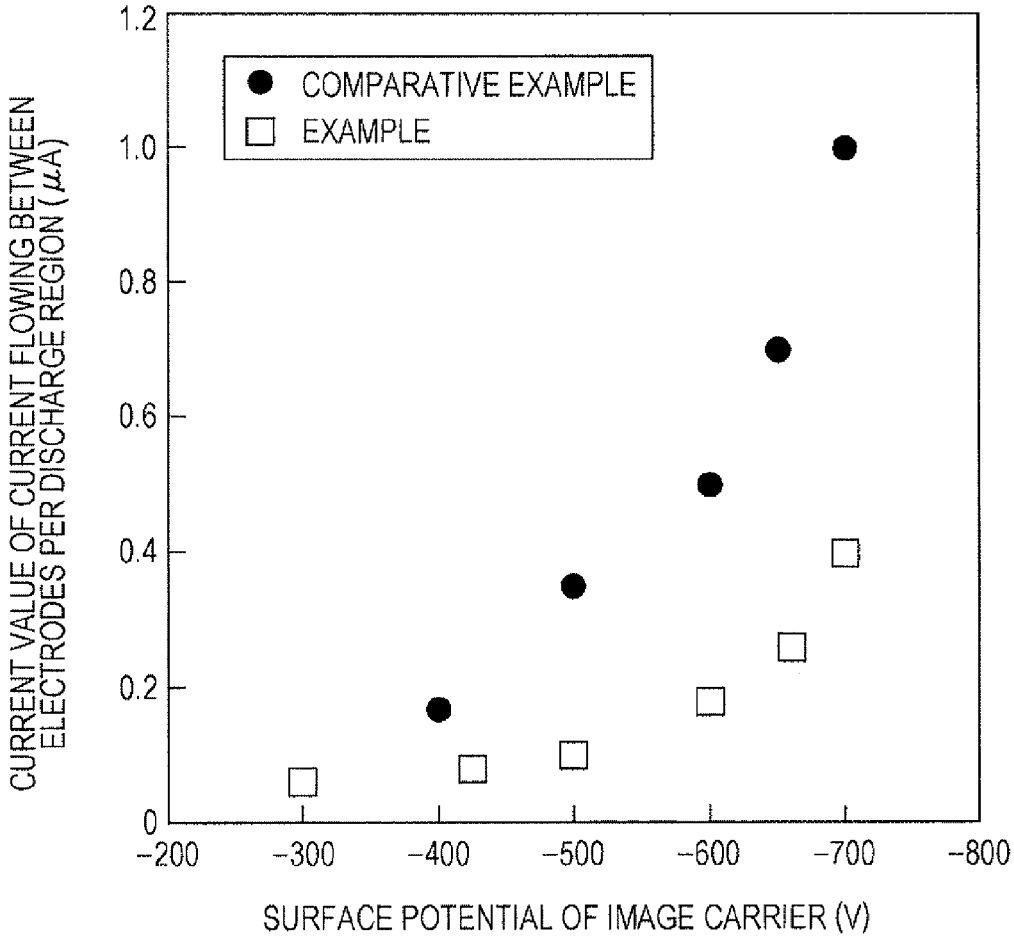
FIG. 6 is a graph of a measurement result indicating the relationships between the current value of a current flowing between electrodes and the surface potential of an image carrier in Example.

FIG. 6 illustrates a measurement result indicating the relationships between the current value (μA) of a current flowing between the electrodes per discharge region and the surface potential (V) of the image carrier 44.

In FIG. 6, in Example, the length a was set to 75 μm, the length b was set to 35 μm, which is a distance from a line the same as a line that is along the stacking direction on the side face of the insulating layer 76, and the length c was set to 110 μm. In Comparative Example, the length a was set to 75 μm, the length b was set to 0 μm, which is a distance from a line the same as a line that is along the stacking direction on the side face of the insulating layer 76, and the length c was set to 75 μm.

In both Example and Comparative Example, the length d was set to 100 μm, and the length e was set to 20 μm.

As illustrated in FIG. 6, for example, in order to obtain a potential of −700 V as the surface potential of the image carrier 44, in Comparative Example, the current value was equal to or larger than 1 μA. In contrast, in Example, the current value was about 0.4 μA. Similarly, in order to obtain a potential of −500 V as the surface potential of the image carrier 44, in Comparative Example, the current value was about 0.3 μA. In contrast, in Example, the current value was about 0.1 μA.

As described above, as a result, in Example, using a current value that was equal to or smaller than half a current value in the Comparative Example, the image carrier 44 was charged so as to have a potential which was the same as a potential in the Comparative Example.

Second Exemplary Embodiment

Next, a second exemplary embodiment will be described.

Figure 7:
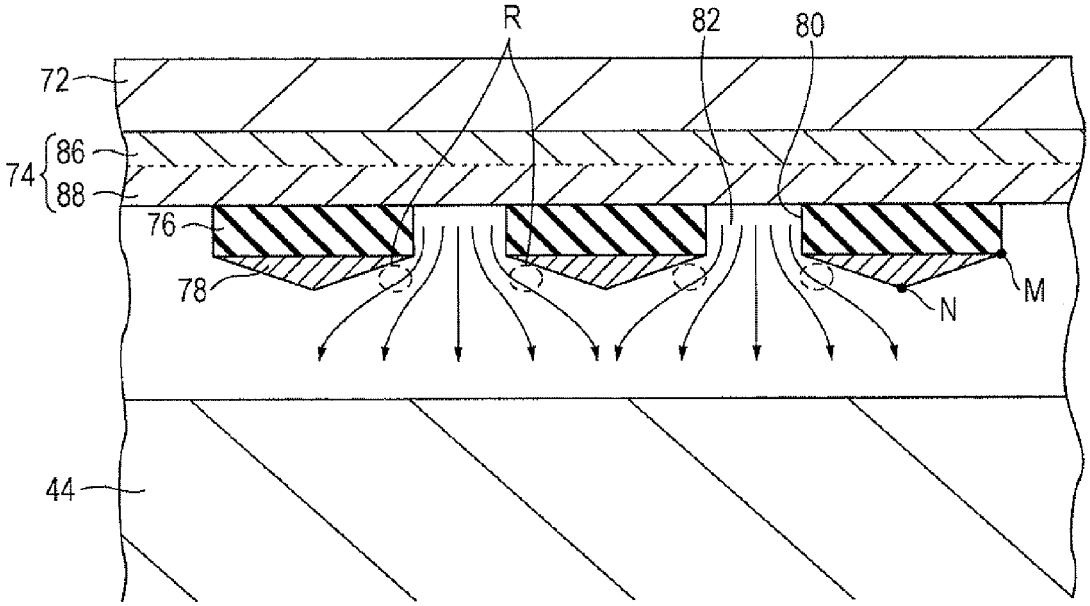
FIG. 7 is a schematic diagram of the discharge region and a structure of portions surrounding the discharge region in a second exemplary embodiment.

FIG. 7 is a schematic diagram of the discharge region 84 and a structure of portions surrounding the discharge region 84 in the second exemplary embodiment.

In the second exemplary embodiment, a configuration is provided, in which the length b increases with decreasing distance to the image carrier 44 side. The length e (the thickness of the conductive layer 78) decreases with decreasing distance to the opening 80.

With this configuration, the conductive layer 78 is formed so as to extend to the vicinity of the opening 80 without overlapping the range R.

Third Exemplary Embodiment

Next, a third exemplary embodiment will be described.

Figure 8:
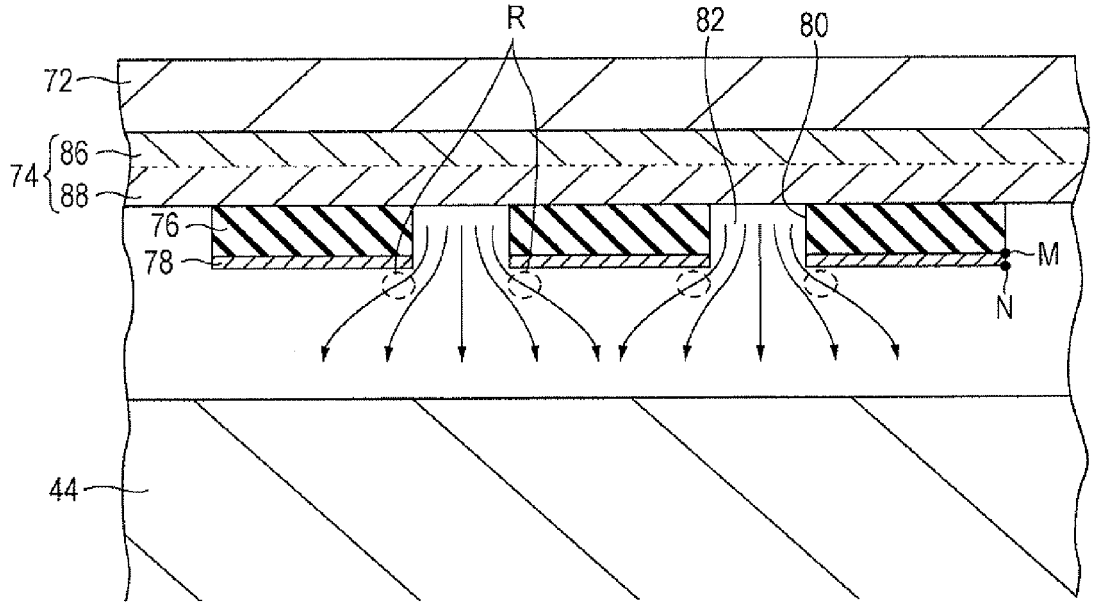
FIG. 8 is a schematic diagram of the discharge region and a structure of portions surrounding the discharge region in a third exemplary embodiment.

FIG. 8 is a schematic diagram of the discharge region 84 and a structure of portions surrounding the discharge region 84 in the third exemplary embodiment.

In the third exemplary embodiment, in order that the conductive layer 78 not overlap the range R, a configuration is provided, in which the length e (the thickness of the conductive layer 78) is in a very small range.

With this configuration, the conductive layer 78 is formed so as to extend to the vicinity of the opening 80 without overlapping the range R.

In the third exemplary embodiment, the lengths a to e have, for example, the following relationships:

$2\ \mu m \leq a \leq c \leq 200\ \mu m$;

$0 \leq b \leq c-a \leq 198\ \mu m$;

$4\ \mu m \leq d \leq 500\ \mu m$;

and $0 < e \leq 1\ \mu m$.

As described above, if the thickness of the conductive layer 78 is in a very small range (for example, $0<e\leq 1\ \mu m$), the lengths a and c may be the same (an equation a=c may be established).

In the present exemplary embodiment, the conductive layer 78 is formed by evaporation, such as a sputtering method, so as to have a thickness of 200 nm.

In the above-described exemplary embodiments, examples of application of the present invention to the charging device of the image forming apparatus are described. The present invention is not limited thereto. The present invention may also be applied as a charged particle generator to the following examples of usage:

a de-charge treatment for, in a process of producing an electronic device or the like, neutralizing generated charges by supplying charges having a reversed polarity so as to prevent the electronic device from being damaged due to static electricity caused by charging the electronic device;

a surface modification treatment of modifying a surface of a solid material (such as a hydrophilizing treatment or a hydrophobizing treatment);

a disinfection treatment or a sterilization treatment in food processing or medical fields; and air cleaning.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charged particle generator comprising:

a first electrode;

a second electrode; and an insulating material that is provided between the first electrode and the second electrode, wherein the first electrode includes a first layer, a second layer, and a third layer, the first layer and the second layer being resistive layers having different values of volume resistivity, the first layer contacting the insulating material, the second layer contacting the third layer, and the third layer being a conductive base material, wherein charged particles are generated by discharge that occurs between the first and the second electrodes, wherein the first electrode, the insulating material, and the second electrode are arranged in a first direction, wherein the second electrode has an opening that is open in the first direction, wherein the insulating material has a region limiter, wherein the region limiter is a space that is open at one end in the first direction and continuous to the opening, that is closed at the other end in the first direction by the first electrode, and that is surrounded by the insulating material in a second direction, and wherein an area of the opening is larger than that of the region limiter.

2. The charged particle generator according to claim 1, wherein the area of the opening increases with increasing distance from the insulating material.

3. The charged particle generator according to claim 2, wherein the insulating material is in contact with the opening in a predetermined range from a boundary between the insulating material and the region limiter in the second direction.

4. The charged particle generator according to claim 1, wherein the insulating material is in contact with the opening in a predetermined range from a boundary between the insulating material and the region limiter in the second direction.

5. A charging device comprising the charged particle generator according to claim 1, the charging device charging a member to be charged.

6. An image forming apparatus comprising:

an image carrier that serves as a member to be charged;

the charging device according to claim 5, the charging device being disposed so as not to be in contact with the image carrier and charging the image carrier;

a developing device that develops, using a developer, a latent image which has been formed by exposure on the image carrier charged by the charging device;

a transfer unit that transfers, onto a recording medium, the image which has been developed by the developing device; and a fixing unit that fixes, onto the recording medium, the image which has been transferred onto the recording medium by the transfer unit.

7. The charged particle generator according to claim 1, wherein a plasma forming region between a first insulating layer and a neighboring insulating layer is disposed with a substantially level surface.

8. The charged particle generator according to claim 1, the second electrode having a thickness of between 1 and 50 um, and a thickness of the insulating material being between 30 um and 500 um.

9. The charged particle generator according to claim 1, wherein the volume resistivity of the second layer is larger than the volume resistivity of the first layer.

10. The charged panicle generator according to claim 1, wherein both the respective volume resistivity of the first layer and the respective volume resistivity of the second layer are in a range of $10^6\ \Omega\cdot cm$ to $10^{10}\ \Omega\cdot cm$.

11. The charged particle generator according to claim 1, wherein the region limiter extends along an entire thickness of the insulating material in the first direction.

* * * * *